US009030116B2

(12) United States Patent
Lin et al.

(10) Patent No.: US 9,030,116 B2
(45) Date of Patent: May 12, 2015

(54) LOAD DRIVING APPARATUS AND DRIVING METHOD THEREOF

(71) Applicant: Beyond Innovation Technology Co., Ltd., Taipei (TW)

(72) Inventors: Chiu-Yuan Lin, Taipei (TW); Nan-Chuan Huang, Taipei (TW); Chen-Lung Kao, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 64 days.

(21) Appl. No.: 14/056,954

(22) Filed: Oct. 18, 2013

(65) Prior Publication Data

US 2014/0167637 A1 Jun. 19, 2014

(30) Foreign Application Priority Data

Dec. 14, 2012 (TW) ..... 101147621

(51) Int. Cl.
*H05B 33/08* (2006.01)

(52) U.S. Cl.
CPC ..... *H05B 33/0818* (2013.01)

(58) Field of Classification Search
None
See application file for complete search history.

(56) References Cited

U.S. PATENT DOCUMENTS

| | | | | |
|---|---|---|---|---|
| 7,420,333 | B1 * | 9/2008 | Hamdad et al. | 315/224 |
| 8,593,075 | B1 * | 11/2013 | Melanson et al. | 315/291 |
| 2002/0140371 | A1 * | 10/2002 | Chou et al. | 315/224 |
| 2006/0261746 | A1 * | 11/2006 | Huang et al. | 315/209 R |
| 2011/0227492 | A1 * | 9/2011 | Du et al. | 315/186 |
| 2011/0227493 | A1 * | 9/2011 | Du et al. | 315/192 |
| 2012/0043899 | A1 * | 2/2012 | Veskovic | 315/200 R |
| 2012/0043900 | A1 * | 2/2012 | Chitta et al. | 315/201 |
| 2012/0112646 | A1 * | 5/2012 | Shiu et al. | 315/186 |
| 2012/0181940 | A1 * | 7/2012 | Snelten et al. | 315/186 |
| 2013/0106305 | A1 * | 5/2013 | Whitaker et al. | 315/210 |

* cited by examiner

*Primary Examiner* — Crystal L Hammond
(74) *Attorney, Agent, or Firm* — Winston Hsu; Scott Margo

(57) ABSTRACT

A load driving apparatus and a driving method thereof are provided. The load driving apparatus includes a power conversion circuit and a control chip. The power conversion circuit receives a DC input voltage, and drives an LED load in response to a gate PWM signal. The control chip is configured to: provide the gate PWM signal having a first preset duty cycle during a light operation period of a dimming operation, so that the LED load is fully turned on; and provide the gate PWM signal having a second preset duty cycle during a dark operation period of the dimming operation, so that the LED load is slightly turned on. The second preset duty cycle is far less than the first preset duty cycle. A current of the LED load during the light operation period is far more than a current of the LED load during the dark operation period.

12 Claims, 2 Drawing Sheets

LOAD DRIVING APPARATUS AND DRIVING METHOD THEREOF

CROSS-REFERENCE TO RELATED APPLICATION

This application claims the priority benefit of Taiwan application serial no. 101147621, filed on Dec. 14, 2012. The entirety of the above-mentioned patent application is hereby incorporated by reference herein and made a part of this specification.

BACKGROUND OF THE INVENTION

1. Field of the Invention

The invention relates to a load driving apparatus, and particularly to, a light-emitting diode driving apparatus and a driving method thereof.

2. Description of Related Art

Conventionally, a light-emitting diode (LED) driving apparatus is generally composed by circuits such as a control chip, a power switch and an external circuit, etc. The control chip may provide a driving signal to switch the power switch, so that the LED(s) may emit light according to a current generated by switching of the power switch. In order to achieve a high contrast ratio with conventional LED dimming technologies, a Pulse Width Modulation (PWM) dimming technology is generally used by the driving apparatus. A dimming principle thereof is to control a time proportion/ratio of the LED(s) in full brightness and full dark state by adjusting a duty cycle of a PWM dimming signal, so as to complete a dimming operation.

Generally, in illuminating applications of LED, a voltage is provided to turn on or activate an LED driving apparatus. After the LED driving apparatus is turned on or activated, a partial of electrical energy used in LED operations are to be retrieved and fed back as power for the LED driving apparatus. However, when LED(s) is/are in a full dark state, since time for LED(s) being turned on is shorten, time and energy to be provided to the LED driving apparatus is relatively less, accordingly. Therefore, when LED(s) is/are in full dark state, the control chip in the LED driving apparatus may not operate normally due to insufficient power. Generally, a large external capacitor is required for providing power to the control chip, so that the control chip may operate normally through when LED(s) is/are in full dark state. Nevertheless, the LED driving apparatus may still stop operating when said capacitor is insufficient. In addition, if increasing the capacitance of the large external capacitor, not only the processing cost is increased, but also an area required for a printed circuit board (PCB) is increased.

SUMMARY OF THE INVENTION

The invention is directed to a load driving apparatus, which may continuously output a pulse width modulation (PWM) signal having a corresponding duty cycle according to different periods of a dimming operation to effectively complete the dimming operation, and problems such as the load driving apparatus having insufficient power during a full dark state may also be avoided.

A load driving apparatus including a power conversion circuit and a control chip is provided. The power conversion circuit is configured to receive a DC input voltage and drive a light-emitting diode (LED) load in response to a gate pulse width modulation (PWM) signal. The control chip is coupled to the power conversion circuit and operated under the DC input voltage, the control chip is configured to: provide the gate PWM signal having a first preset duty cycle during a light operation period of a dimming operation, so that the LED load is fully turned on; and provide the gate PWM signal having a second preset duty cycle during a dark operation period of the dimming operation, so that the LED load is slightly turned on, in which the second preset duty cycle is substantially far less than the first preset duty cycle, and a current of the LED load during the light operation period is substantially far more than a current of the LED load during the dark operation period.

A load driving method is also provided, the method includes: providing a gate PWM signal having a first preset duty cycle during a light operation period of a dimming operation to thereby fully turn on an LED load; and providing the gate PWM signal having a second preset duty cycle during a dark operation period of the dimming operation to thereby slight turn on the LED load, in which the second preset duty cycle is substantially far less than the first preset duty cycle, and a current of the LED load during the light operation period is substantially far more than a current of the LED load during the dark operation period.

According to an embodiment of the invention, the control chip has a power pin, a ground pin and an output pin. The control chip receives the DC input voltage through the power pin and converts the DC input voltage to generate an operating voltage required by the control chip in operation. The ground pin is in a floating state. The control chip is configured to output the gate PWM signal through the output pin to thereby control an operation of the power conversion circuit.

According to an embodiment of the invention, the control chip further has a compensation pin. The control chip provides a compensating voltage through the compensation pin to adjust a duty cycle of the gate PWM signal.

According to an embodiment of the invention, the control chip further has a sensing pin. The control chip senses a current flowing through a current sensing circuit through the sensing pin, so as to adjust a duty cycle of the gate PWM signal.

According to an embodiment, the control chip further has a detecting pin, the control chip is configured to detect an ON/OFF state of a switch element within a DC voltage generating circuit, so as to adjust a duty cycle of the gate PWM signal.

According to an embodiment of the invention, the power conversion circuit may be a buck power conversion circuit, and the buck power conversion circuit includes a power switch, a filter circuit and an electricity feedback circuit. The power switch has a first terminal, a second terminal and a control terminal, wherein the first terminal of the power switch is configured to receive the DC input voltage, the second terminal of the power switch is coupled to a ground potential through a Schottky diode, and the control terminal of the power switch is coupled to the output pin to receive the gate PWM signal. The filter circuit is coupled between the ground pin and the LED load, and configured to generate a constant current in response to a switching of the power switch to drive the LED load. The electricity feedback circuit is coupled between the power pin and the LED load, and configured to provide the operating voltage required by the control chip in operation during driving the LED load.

According to an embodiment of the invention, the power conversion circuit further includes a frequency setting circuit having a resistor. A first terminal of the resistor of the frequency setting circuit is coupled to the output pin, a second terminal of the resistor of the frequency setting circuit is coupled to the second terminal of the power switch, and the control chip sets a frequency of the gate PWM signal in response to a resistance of the resistor of the frequency setting circuit.

According to an embodiment of the invention, the current sensing circuit includes a resistor. A first terminal of the resistor of the current sensing circuit is coupled to the sensing pin, and a second terminal of the resistor of the current sensing circuit is coupled to the ground pin.

According to an embodiment of the invention, the power conversion circuit further includes a compensation circuit. The compensation circuit is coupled between the compensation pin and the ground pin, and configured to compensate a phase margin of the load driving apparatus.

According to an embodiment of the invention, the filter circuit includes an inductor and a capacitor. The inductor has a first terminal coupled to the ground pin and a second terminal coupled to an anode of the LED load. The capacitor has a first terminal coupled to a second terminal of the inductor and the anode of the LED load, and a second terminal coupled to the ground potential.

According to an embodiment of the invention, the power conversion circuit further includes a voltage divider circuit configured to obtain a detecting voltage in response to a dividing voltage on a voltage detection terminal, and obtain the ON/OFF state of the switch element within the DC voltage generating circuit by comparing the detecting voltage with a reference detecting voltage.

In view of above, the invention may provide a PWM signal with a smaller duty cycle constantly for the LED during a dark operation of the dimming operation. Therefore, the LED driving apparatus may have a sufficient power supply during the dark operation period, which means that operations may not be stopped due to insufficient power and larger capacitor is not required additionally to support it through said period. As a result, processing cost thereof may be reduced and the area required for a printed circuit board (PCB) may also be reduced.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
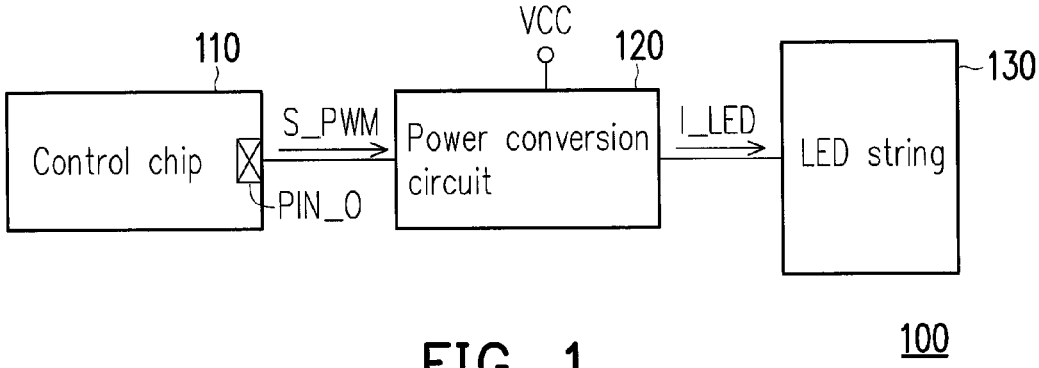
FIG. 1 is a block schematic view of a load driving apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a block schematic view of a load driving apparatus according to an embodiment of the invention. In the present embodiment, a load driving apparatus 100 is at least suitable for driving a light-emitting diode (LED) load such as an LED string 130. Referring to FIG. 1, the load driving apparatus 100 includes a power conversion circuit 120 and a control chip 110. The power conversion circuit 120 is coupled to the LED string 130. The control chip 110 is coupled to the power conversion circuit 110 and configured to control the operation(s) of the power conversion circuit 120. In a structure/configuration of the power conversion circuit 120 as illustrated in FIG. 1, the power conversion circuit 120 toggles/switches on or off the power conversion circuit 120 in response to a gate Pulse Width Modulation (PWM) signal S_PWM provided by an output pin PIN_O of the control chip 110, so as to drive the LED string 130 in response to a conversion related to the DC input voltage VCC.

Figure 2:
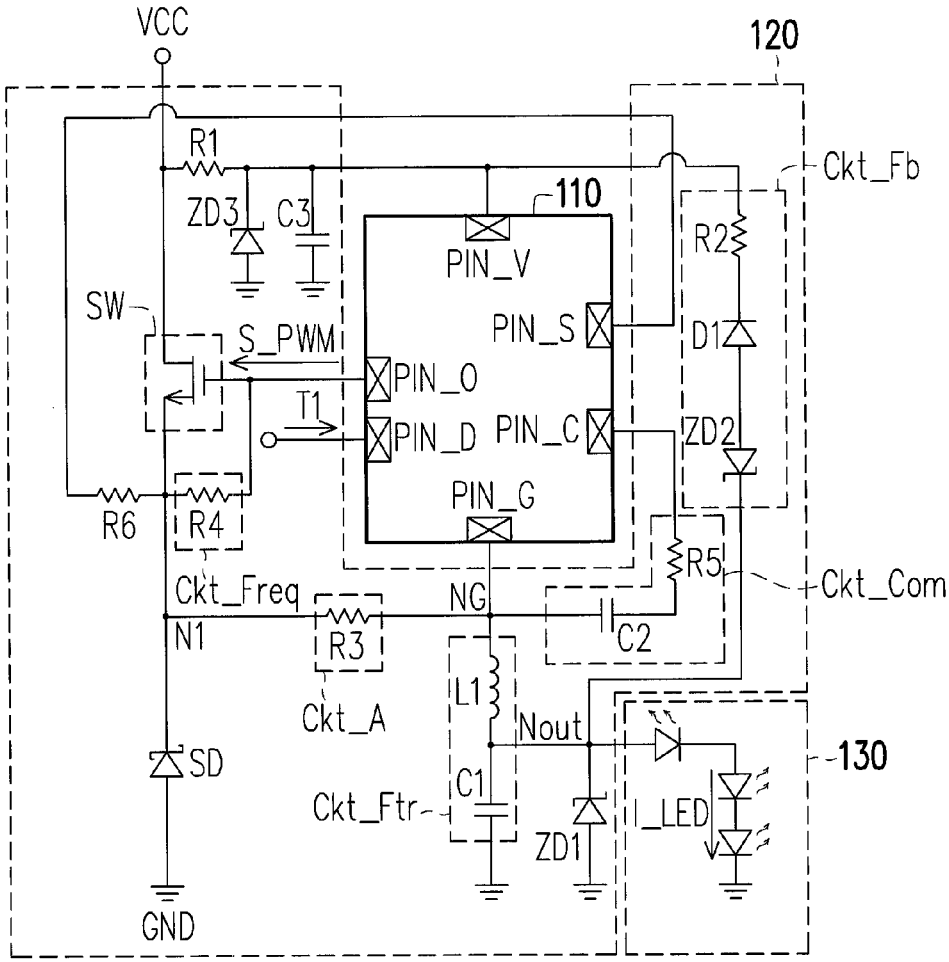
FIG. 2 is a schematic view of circuits in a load driving apparatus according to an embodiment of the invention.

Embodiments of the present invention are described in detail hereinafter with reference of FIG. 2. FIG. 2 is a schematic view of circuits in a load driving apparatus according to an embodiment of the invention.

Referring to FIG. 2, according to the present embodiment, the load driving apparatus 100 includes the power conversion circuit 120 and the control chip 110. Structurally, it is described hereinafter with the power conversion circuit 120 being a buck power conversion circuit. The power conversion circuit 120 includes a power switch SW, a Schottky diode SD, a frequency setting circuit Ckt_Freq, a current sensing circuit Ckt_A, a filter circuit Ckt_Ftr, an electricity feedback circuit Ckt_Fb, a compensation circuit Ckt_Com, a voltage divider circuit Ckt_Dv (not illustrated, detail thereof will be described later in FIG. 3) and resistors R1 and R6. The control chip 110 receives the DC input voltage VCC through a power pin PIN_V to be turned on or activated under the DC input voltage VCC, namely, the control chip 110 is operated under the DC input voltage VCC, for example, the DC input voltage VCC is converted to obtain an operating voltage required by the control chip 110 in operation. The control chip 110 controls the operation(s) of the power conversion circuit 120 through the gate PWM signal S_PWM output by the output pin PIN_O, so as to drive the LED string 130 and perform a dimming operation. In the present embodiment, the power conversion circuit 120 is a buck-based power conversion circuit.

Figure 3:
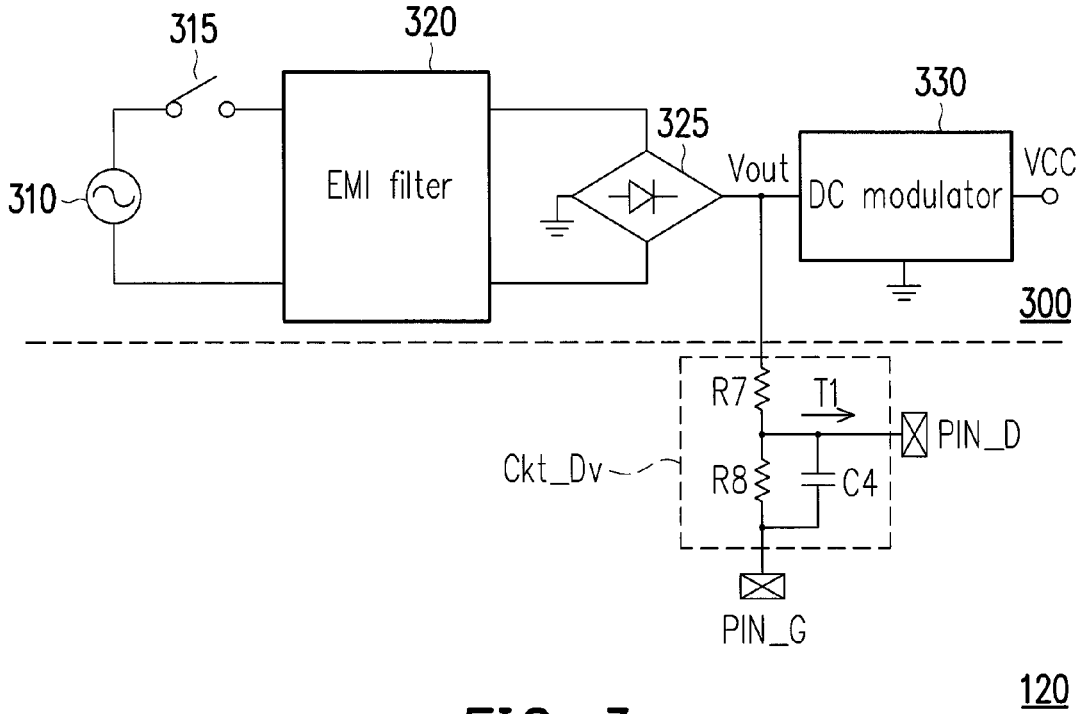
FIG. 3 is a schematic view of circuits of a power conversion circuit coupled to a DC voltage generating circuit according to the invention.

Referring to FIG. 3, FIG. 3 is a schematic view of circuits of a power conversion circuit coupled to a DC voltage generating circuit 300 according to the invention. Referring to FIG. 2 and FIG. 3 together, the DC voltage generating circuit 300 of the present embodiment is implemented by using an AC power 310, a switch element 315, an electromagnetic interference (EMI) filter 320 and a bridge rectifier 325, but the invention is not limited thereto. In addition, the DC voltage generating circuit 300 further includes a DC modulator 330, in which the DC voltage generating circuit 300 may provide the DC input voltage VCC required for the power conversion circuit 120 and the control chip 110 through the DC modulator 330.

In a structure/configuration of the DC voltage generating circuit 300, the control chip 110 may adjust an ON/OFF ratio in a duty cycle of the gate PWM signal S_PWM in response to an ON/OFF state of the switch element 315 within the DC voltage generating circuit 300.

More specifically, the control chip 110 further includes a detecting pin PIN_D, and the detecting pin PIN_D is coupled to the voltage divider circuit Ckt_Dv of the power conversion circuit 120, so that the control chip 110 may obtain a detecting voltage T1 in response to a dividing voltage on a detecting voltage terminal Vout through the voltage divider circuit Ckt_Dv, and obtain the ON/OFF state of the switch element 315 within the DC voltage generating circuit 300 by comparing the detecting voltage T1 with a reference detecting voltage. Therefore, the control chip 110 may adjust the ON/OFF ratio of the duty cycle of a PWM operation according to the ON/OFF state of the switch element 315 within the DC voltage generating circuit 300 such as a number of times for the switch element 315 being turned on, so as to change a brightness required by the LED string 130. Herein, the brightness of the LED string 130 is corresponding to a magnitude of a current I_LED flowing through the LED string 130.

For instance, when the number of times for the switch element 315 being turned on is one, a corresponding ON/OFF proportion/ratio of the duty cycle of the PWM operation is 75% ON and 25% OFF. When the number of time for the switch element 315 being turned on is two, the corresponding ON/OFF proportion/ratio of the duty cycle of the PWM operation is 50% ON and 50% OFF. However, the proportion/ratio of the duty cycle of the PWM operation as embodied above is merely a design choice or actual design/application requirement, so the invention is not limited thereto.

In addition, the voltage divider circuit Ckt_Dv may perform the voltage division to the detecting voltage terminal Vout of the DC voltage generating circuit 300 by using a structure of resistors R7 and R8 and a capacitor C4, so as to obtain the corresponding detecting voltage T1, and the capacitor C4 may also be used to perform a voltage regulation to the detecting voltage T1, but the structure of the voltage divider circuit Ckt_Dv is not limited only to be as the embodiment illustrated in FIG. 2.

Referring back to FIG. 2, the power conversion circuit 120 receives the DC input voltage VCC output by the DC voltage generating circuit 300, and the power conversion circuit 120 further includes Zener diodes ZD1 and ZD3 and a capacitor C3. A cathode terminal of the Zener diode ZD1 is coupled to a node Nout, and an anode terminal of the Zener diode ZD1 is coupled to a ground potential GND to assure that the node Nout has a stable voltage. A cathode terminal of the Zener diode ZD3 is coupled to the DC input voltage VCC through the resistor R1, and an anode terminal of the Zener diode ZD3 is coupled to the ground voltage GND. The capacitor C3 is coupled between DC input voltage VCC and the ground voltage GND through the resistor R1. As a result, the control chip 110 may receive the DC input voltage VCC stably through the capacitor C3 and the Zener diode ZD3.

The power conversion circuit 120 further includes an electricity feedback circuit Ckt_Fb coupled between the power pin PIN_V of the control chip 110 and the node Nout. The electricity feedback circuit Ckt_Fb may provide an operating voltage required for the control chip 110 in operation during driving the LED string 130, so as to replace the DC input voltage VCC originally being used as the power provided to the control chip 110. Herein, the electricity feedback circuit Ckt_Fb may be implemented by a feedback path composed by connecting a Zener diode ZD2, a resistor R2 and a diode D1 in series, but the invention is not limited by such disclosure.

The power conversion circuit 120 further includes a current sensing circuit Ckt_A coupled through the resistor R6 to a sensing pin PIN_S of the control chip 110. The control chip 110 may sense a current flowing through the current sensing circuit Ckt_A, and then adjust the duty cycle of the gate PWM signal S_PWM output by the output pin PIN_O of the control chip 110. In other words, the control chip 110 may adjust the duty cycle of the gate PWM signal S_PWM in response to the current (i.e. the magnitude of the current I_LED for driving the LED string 130) flowing through the current sensing circuit Ckt_A. In this embodiment, when a resistance of the LED string 130 remains unchanged, the current I_LED flowing through the LED string 130 may be changed with the variation of voltage on the node Nout.

Specifically, the current sensing circuit Ckt_A may be implemented by a structure of the resistor(s), the current sensing circuit Ckt_A herein is illustrated by having a resistor R3 as an example. More specifically, a first terminal of the resistor R3 is coupled to the sensing pin PIN_S through the resistor R6, and a second terminal of the resistor R3 is coupled to the ground pin PIN_G. It should be noted that, the current sensing circuit Ckt_A is not limited to be implemented only by the structure of the resistor(s), even though the resistor R3 disposed between nodes N1 and NG is illustrated herein as an example. Nevertheless, any circuitries or structures which may cause the ground pin PIN_G in the floating state to drop voltage may be used to replace the resistor R3, the invention is not limited thereto.

In the power conversion circuit 120, the power switch SW has a first terminal, a second terminal and a control terminal, in which the first terminal of the power switch SW receives the DC input voltage VCC, the second terminal of the power switch SW is coupled to a ground potential GND through the node N1 and the Schottky diode SD, and the control terminal of the power switch SW is coupled to the output pin PIN_O of the control chip 110 to receive the gate PWM signal S_PWM output from the control chip 110. Therefore, the power switch SW may be toggled/switched on or off in response to the gate PWM signal S_PWM provided by the control chip 110, such that the power conversion circuit 120 may drive the LED string 130 according to the conversion related to the DC input voltage VCC and the switching of the power switch SW.

The power conversion circuit 120 further includes a filter circuit Ckt_Ftr coupled between the node NG (equivalent to be coupled to the ground pin PIN_G of the control chip 110) and the LED string 130, the filter circuit Ckt_Ftr is used to drive the LED sting 130 by generating a constant current in response to the switching of the power switch SW. In the present embodiment, the filter circuit Ckt_Ftr is implemented by a structure of an inductor L1 and a capacitor C1. Furthermore, the inductor L of the filter circuit Ckt_Ftr has a first terminal coupled to the node NG, and a second terminal coupled to the node Nout (equivalent to an anode terminal of the LED sting 130), whereas the capacitor C1 of the filter circuit Ckt_Ftr has a first terminal coupled to the second terminal of the inductor L and the node Nout, and a second terminal coupled to the ground potential GND. The inductor L and the capacitor C1 may be used to provide a filtering functionality, so as to generate the constant current to drive the LED string 130.

Regarding the power switch SW and the filter circuit Ckt_Ftr, when the power switch SW is turned on according to the gate PWM signal S_PWM provided by the control chip 110, the power conversion circuit 120 may provide a bias voltage stably to the node N1 because the inductor L1 is able to store power/energy in response to the voltage of the node N1 and thereby generate the current I_LED for driving the LED string 130. Once the power switch SW is turned off according to the gate PWM signal S_PWM provided by the control chip 110, the inductor L1 may release power/energy so as to generate the driving current I_LED constantly or continuously.

In the present embodiment, a configuration of the Schottky diode SD, the inductor L1 and the capacitor C1 is merely design choice. In other words, in other embodiments, functionality of the Schottky diode SD may be implemented by person with ordinary skill in the art using other voltage stabilizers or other stabilizer circuit structures, and functionality of the inductor L and the capacitor C1 in the power conversion circuit 120 may also be implemented by other filter devices, the invention is not limited to the configuration as illustrated in FIG. 2.

On the other hand, the ground pin PIN_G of the control chip 110 is coupled to the node NG, and the voltage level of the node NG is used as a reference voltage level of the control chip 110. Specifically, when the power switch SW is turned on, since the power conversion circuit 120 may generate a current that flows through the power switch SW, the node N1, the resistor R3 and the inductor L1, which means that a current direction of the current is flowing from the node N1 to the node NG. Therefore, regardless of a voltage level of the node N1 or a magnitude of the current that flows through the resistor R3 may be, the voltage level of the node NG may be smaller than a voltage level of the node N1 in response to a voltage drop of the resistor R3. Accordingly, the voltage level of the node NG shall be smaller than any one of the nodes in the power conversion circuit 120, so that each of the pins in the control chip 110 cannot have the voltage level being lower than a voltage level of the ground pin PIN_G, regardless of which node of the power conversion circuit 120 is coupled thereto.

Furthermore, since the ground pin PIN_G of the control chip 110 is in a floating state, such that the ground pin PIN_G may have a lowest level voltage in control chip 110. Therefore, a reversed conduction state will not occur between the pins in the control chip 110. In addition, the ground pin PIN_G in the floating state indicates that the voltage level of the ground pin PIN_G may be changed with a source of the current flowing through the resistor R3 (e.g., flowing through the power switch SW to the resistor R3 by the DC input voltage VCC, or the current continued to flow from the inductor L1), so as to remain being the lowest voltage level in the control chip 110.

Moreover, the output pin PIN_O of the control chip 110 is coupled to the frequency setting circuit Ckt_Freq configured to set a frequency of the gate PWM signal S_PWM in response to electrical properties of the frequency setting circuit Ckt_Freq. In the present embodiment, the frequency setting circuit Ckt_Freq may be implemented by the structure of resistor(s), the frequency setting circuit Ckt_Freq is illustrated herein by having a resistor R4 as an example. The resistor R4 has a first terminal coupled to the output pin PIN_O and a second terminal coupled to the node N1, in which designers may set the frequency of the gate PWM signal S_PWM correspondingly by adjusting a resistance of the resistor R4. Nevertheless, the frequency setting circuit Ckt_Freq of the embodiment is not limited only to be implemented by the structure of resistor(s).

The control chip 110 is coupled to the compensation circuit Ckt_Com through a compensation pin PIN_C, in which the control chip 110 provides a compensating voltage to adjust the duty cycle of the gate PWM signal S_PWM. In addition, the control chip 110 may compensate a phase margin of the load driving apparatus 100 through the compensation circuit Ckt_Com, so as to increase stability in operation while avoiding light-emitting properties of the LED string 130 being affected by oscillation generated during operations of the load driving apparatus 100. The compensation circuit Ckt_Com according to the present embodiment may be implemented by a structure of a capacitor C2 and a resistor R5 as illustrated in FIG. 2, but the invention is not limited thereto.

Figure 4:
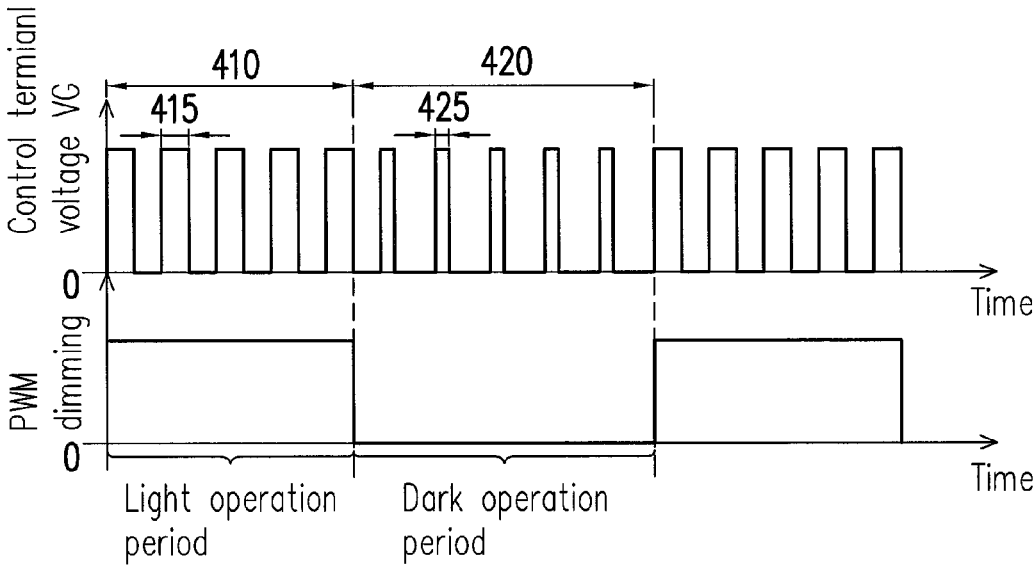
FIG. 4 is a dimming waveform diagram of a pulse width modulation according to an embodiment of the invention.

FIG. 4 is a dimming waveform diagram of a pulse width modulation according to an embodiment of the invention. Referring to FIG. 2 and FIG. 4 together, in the present embodiment, a horizontal axis represents time and a vertical axis at an upper portion represents a control terminal voltage VG, that is, a voltage value of the gate PWM signal (S_PWM) received by the control terminal of the power switch SW in the power conversion circuit 120 as illustrated in FIG. 2. The vertical axis at the upper portion represents a switching frequency of the power switch SW in the power switch conversion circuit 120 as illustrated in FIG. 2. The vertical axis at a lower portion represents a PWM dimming operation inside the control chip 110, and the horizontal axis at the lower portion can be divided into a light operation period 410 and a dark operation period 420. First, the control chip 110 may obtain the ON/OFF state of the switch element 315 in the DC voltage generating circuit 300 through the voltage divider circuit Ckt_Dv in response to the dividing voltage of the detecting voltage terminal Vout in the DC voltage generating circuit 300. The control chip 110 may then adjust the ON/OFF ratio of the duty cycle of the PWM dimming operation, so as to change the brightness required by the LED string 130. The ON/OFF ratio of the duty cycle of the PWM dimming operation may decide a time proportion/ratio of the light operation period 410 and the dark operation period 420.

In addition, in order to achieve the brightness required by the LED string 130 during different operation periods in the invention, during the light operation period 410 and the dark operation period 420 of the dimming operation in the present embodiment, the control chip 110 respectively outputs the gate PWM signals with different duty cycles to adjust the current I_LED flowing through the LED string 130.

Specifically, when the load driving apparatus 100 is in the light operation period 410 of the dimming operation, the control chip 110 is activated by receiving the DC input voltage VCC. The gate PWM signal (S_PWM) having a first pulse width 415 (i.e. S_PWM has a first preset duty cycle) is output by the control chip 110 being activated, and the operating voltage required for the control chip 110 is provided by the electricity feedback circuit Ckt_Fb through the node Nout, so as to replace the DC input voltage VCC. Meanwhile, the LED string 130 is fully turned on. However, when the load driving apparatus 100 is in the dark operation period 420 of the dimming operation, the gate PWM signal (S_PWM) having a second pulse width 425 (i.e. S_PWM has a second preset duty cycle) is constantly/continuously output by the control chip 110 to maintain a minimum operating voltage required for the control chip 110 (which is provided by the electricity feedback circuit Ckt_Fb through the node Nout), such that the control chip 110 may remain being powered on without stop operating. Meanwhile, the LED string 130 is slightly turned on. In this embodiment, the gate PWM signal (S_PWM) having the second preset duty cycle in the dark operation period 420 is far less than the gate PWM signal (S_PWM) having the first preset duty cycle in the light operation period 410. Since a magnitude of the pulse width of the gate PWM signal (S_PWM) may corresponding to the magnitude of the current flowing through the LED string 130, the current flowing through the LED string 130 during the light operation period is far more than the current flowing through the LED string 130 during the dark operation period.

In view of above, the load driving apparatus proposed by the invention may output a PWM signal having a normal duty cycle for the LED during the light operation period of a dimming operation, whereas a PWM signal having a small/slight duty cycle may also be output for the LED during the dark operation period of the dimming operation. Therefore, the LED driving apparatus may have a sufficient power supply during the dark operation period, which means that operations may not be stopped due to insufficient power and larger capacitor is not required additionally to support it through said period. As a result, processing cost thereof may be reduced and the area required for a printed circuit board (PCB) may also be reduced.

Although the invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. A load driving apparatus, comprising:

a power conversion circuit configured to receive a DC input voltage and drive a light-emitting diode (LED) load in response to a gate pulse width modulation (PWM) signal; and a control chip coupled to the power conversion circuit and operated under the DC input voltage, the control chip being configured to:

provide the gate PWM signal having a first preset duty cycle during a light operation period of a dimming operation to thereby fully turn on the LED load; and provide the gate PWM signal having a second preset duty cycle during a dark operation period of the dimming operation to thereby slightly turn on the LED load, wherein the second preset duty cycle is substantially far less than the first preset duty cycle, wherein a current of the LED load during the light operation period is substantially far more than a current of the LED load during the dark operation period.

2. The load driving apparatus of claim 1, wherein the control chip comprises:

a power pin, wherein the control chip is configured to receive the DC input voltage through the power pin and convert the DC input voltage to generate an operating voltage required for the control chip in operation;

a ground pin in a floating state; and an output pin, wherein the control chip is configured to output the gate PWM signal through the output pin to control an operation of the power conversion circuit.

3. The load driving apparatus of claim 2, wherein the control chip further comprises a compensation pin, the control chip is configured to provide a compensating voltage through the compensation pin to adjust a duty cycle of the gate PWM signal.

4. The load driving apparatus of claim 2, wherein the control chip further comprises a sensing pin, the control chip is configured to sense a current flowing through a current sensing circuit through the sensing pin, so as to adjust a duty cycle of the gate PWM signal.

5. The load driving apparatus of claim 1, wherein the control chip further comprises a detecting pin, the control chip is configured to detect an ON/OFF state of a switch element within a DC voltage generating circuit, so as to adjust a duty cycle of the gate PWM signal.

6. The load driving apparatus of claim 2, wherein the power conversion circuit is a buck power conversion circuit, and the buck power conversion circuit comprises:

a power switch having a first terminal, a second terminal and a control terminal, wherein the first terminal of the power switch is configured to receive the DC input voltage, the second terminal of the power switch is coupled to a ground potential through a Schottky diode, and the control terminal of the power switch is coupled to the output pin to receive the gate PWM signal;

a filter circuit coupled between the ground pin and the LED load, and configured to generate a constant current in response to a switching of the power switch to drive the LED load; and an electricity feedback circuit coupled between the power pin and the LED load, and configured to provide the operating voltage required by the control chip in operation during driving the LED load.

7. The load driving apparatus of claim 6, wherein the power conversion circuit further comprises a frequency setting circuit having a resistor, wherein a first terminal of the resistor is coupled to the output pin, a second terminal of the resistor is coupled to the second terminal of the power switch, the control chip sets a frequency of the gate PWM signal in response to a resistance of the resistor.

8. The load driving apparatus of claim 4, wherein the current sensing circuit has a resistor, a first terminal of the resistor is coupled to the sensing pin and a second terminal of the resistor is coupled to the ground pin.

9. The load driving apparatus of claim 3, wherein the power conversion circuit further comprises a compensation circuit coupled between the compensation pin and the ground pin, and configured to compensate a phase margin of the load driving apparatus.

10. The load driving apparatus of claim 6, wherein the filter circuit comprises:

an inductor having a first terminal coupled to the ground pin and a second terminal coupled to an anode of the LED load; and a capacitor having a first terminal coupled to the second terminal of the inductor and the anode of the LED load, and a second terminal coupled to the ground potential.

11. The load driving apparatus of claim 5, wherein the power conversion circuit further comprises a voltage divider circuit configured to obtain a detecting voltage in response to a dividing voltage of on a voltage detection terminal, and obtain the ON/OFF state of the switch element within the DC voltage generating circuit by comparing the detecting voltage with a reference detecting voltage.

12. A load driving method, comprising:

providing a gate PWM signal having a first preset duty cycle during a light operation period of a dimming operation to thereby fully turn on an LED load; and provide the gate PWM signal having a second preset duty cycle during a dark operation period of the dimming operation to thereby slightly turn on the LED load, wherein the second preset duty cycle is substantially far less than the first preset duty cycle, wherein a current of the LED load during the light operation period is substantially far more than a current of the LED load during the dark operation period.

* * * * *